US012571287B2

(12) United States Patent
Li et al.

(10) Patent No.: US 12,571,287 B2
(45) Date of Patent: Mar. 10, 2026

(54) WELLHEAD AUTOMATIC POSITIONING METHOD AND SYSTEM OF PLUGGING AND PERFORATING OPERATION MACHINE

(71) Applicant: BAOJI SAFE PETROLEUM MACHINERY CO., LTD., Baoji (CN)

(72) Inventors: Jianbo Li, Baoji (CN); Liang Bai, Baoji (CN); Dawei Zhang, Baoji (CN); Jianfeng Yao, Baoji (CN); Ziqiang Kang, Baoji (CN); Xijun Jiang, Baoji (CN); Enfeng Yang, Baoji (CN); Rui Mao, Baoji (CN); Bingwen Wei, Baoji (CN)

(73) Assignee: BAOJI SAFE PETROLEUM MACHINERY CO., LTD., Baoji (CN)

( * ) Notice: Subject to any disclaimer, the term of this patent is extended or adjusted under 35 U.S.C. 154(b) by 97 days.

(21) Appl. No.: 18/641,235

(22) Filed: Apr. 19, 2024

(65) Prior Publication Data

US 2025/0052135 A1 Feb. 13, 2025

(30) Foreign Application Priority Data

Aug. 7, 2023 (CN) ..... 202310988504.8

(51) Int. Cl.
*E21B 43/119* (2006.01)
*E21B 33/13* (2006.01)
(Continued)

(52) U.S. Cl.
CPC ..... *E21B 43/119* (2013.01); *E21B 33/13* (2013.01); *E21B 43/11* (2013.01); *E21B 44/00* (2013.01)

(58) Field of Classification Search
CPC ..... E21B 33/13; E21B 43/119; E21B 47/09; E21B 7/022; E21B 33/068; E21B 33/072
See application file for complete search history.

(56) References Cited

U.S. PATENT DOCUMENTS

2019/0337771 A1* 11/2019 Norton ..... E21B 47/13
2020/0048965 A1* 2/2020 Chen ..... E21B 7/02
2025/0052135 A1* 2/2025 Li ..... E21B 43/119

FOREIGN PATENT DOCUMENTS

CN 106232930 A * 12/2016 ..... E21B 15/00
CN 106458542 B * 1/2019 ..... B66C 23/701
(Continued)

*Primary Examiner* — Daniel P Stephenson
(74) *Attorney, Agent, or Firm* — Procopio, Cory, Hargreaves & Savitch LLP

(57) ABSTRACT

A wellhead automatic positioning method and a system of a plugging and perforating operation machine are provided. The method includes: determining a wellhead position, and acquiring standard positioning parameters of a boom according to the wellhead position and a tool string length, where the positioning parameters include a standard extension length L of the boom, a standard lifting length J, and an included angle φ between a projection of the boom and a wellhead; acquiring actual positioning parameters of the boom, where the actual positioning parameters include an actual length L' of the boom, an actual lifting length J', and an initial angle φ' between the projection of the boom and the wellhead; and according to the standard positioning parameters and the actual positioning parameters of the boom, making the boom to extend and retract, lift and lower, and rotate to complete automatic positioning of the wellhead.

9 Claims, 2 Drawing Sheets

(51) Int. Cl.
*E21B 43/11* (2006.01)
*E21B 44/00* (2006.01)

(56) References Cited

FOREIGN PATENT DOCUMENTS

| | | | | | |
|---|---|---|---|---|---|
| CN | 115305980 | A | * | 11/2022 | ..... E02F 3/435 |
| CN | 118128447 | A | * | 6/2024 | ..... E21B 19/00 |

* cited by examiner

WELLHEAD AUTOMATIC POSITIONING METHOD AND SYSTEM OF PLUGGING AND PERFORATING OPERATION MACHINE

CROSS-REFERENCE TO RELATED APPLICATION

This patent application claims the benefit and priority of Chinese Patent Application No. 202310988504.8, entitled "WELLHEAD AUTOMATIC POSITIONING METHOD AND SYSTEM OF PLUGGING AND PERFORATING OPERATION MACHINE" filed on Aug. 7, 2023, the disclosure of which is incorporated by reference herein in its entirety as part of the present application.

TECHNICAL FIELD

The present disclosure relates to the technical field of oil and gas field cable logging, and in particular to a wellhead automatic positioning method and a system of a plugging and perforating operation machine.

BACKGROUND

The anti spray pipe string of the plugging and perforating operation machine is operated by manually operating a handle, which is complicated in operation and often needs experienced personnel to operate, resulting in low efficiency. Moreover, it is easy to cause misoperation in the process of docking, leading to the damage of equipment, and the risk factor is high.

The existing plugging and perforating operations are all conducted by workers on the spot and operated according to experience, and remote control and automatic positioning identification cannot be carried out through devices, which makes the wellhead operation process complicated and reduces safety and work efficiency.

SUMMARY

For the defects or disadvantages above, the embodiments aim to provide a wellhead automatic positioning method and system of a plugging and perforating operation machine.

To achieve the objective above, the technical solution adopted by the present disclosure is as follows.

A wellhead automatic positioning method of a plugging and perforating operation machine includes:

- determining a position of a wellhead, and acquiring standard positioning parameters of a boom according to the wellhead position and a tool string length, wherein the positioning parameters comprise a standard extension length L of the boom, a standard lifting length J, and a first included angle φ between a projection of the boom and the wellhead;
- acquiring actual positioning parameters of the boom, wherein the actual positioning parameters comprise an actual length L' of the boom, an actual lifting length J', and an initial angle φ' between the projection of the boom and the wellhead; and
- extending and retracting, lifting and lowering, and rotating and adjusting the boom according to the standard positioning parameters and the actual positioning parameters of the boom to complete automatic positioning of the wellhead.

Determining the wellhead position may include:

- acquiring the position of the wellhead through a positioning component, and determining a first distance R between the wellhead and a bottom of the boom, and the first included angle between the projection of the boom and the wellhead.

The positioning component may include an image identification device, or a positioning sensor.

Determining the first distance R between the wellhead and the bottom of the boom may be measuring a distance R between the wellhead and the bottom of the boom by a distance sensor.

Acquiring the standard positioning parameters of the boom according to the wellhead position and a tool string length specifically may include:

- acquiring the first distance R between the bottom of the boom and the wellhead according to the wellhead position;
- setting a height H between an end of the boom and the wellhead according to the tool string length;
- obtaining a second included angle α between the boom and a horizontal direction according to the first distance R between the bottom of the boom and the wellhead and the height H between the end of the boom and the wellhead:
- the standard extension length L of the boom may be equal to H×sin α;
- the standard lifting length may be as $J=\sqrt{a^2+b^2-2ab\cos\alpha}$, a may be a second distance between a top of a lift cylinder and the bottom of the boom, and b may be a third distance between a bottom of the lift cylinder and the bottom of the boom.

Acquiring the actual positioning parameters of the boom specifically may include:

- collecting an extension length of the boom through a first draw-wire displacement sensor installed on the boom, wherein a sum of the extension length and an original length of the boom is the actual length L' of the boom;
- collecting an extension length of the lift cylinder through a second draw-wire displacement sensor installed on the lift cylinder, wherein a sum of the extension length of the lift cylinder of the boom and an original length of the lift cylinder is the actual lifting length J' of the lift cylinder; and
- acquiring a third included angle between the boom at an initial position and the boom at a positioning position as the initial angle φ' through an angle sensor, or acquiring a recorded rotating angle as the initial angle φ' after rotating the boom to the positioning position.
- extending and retracting, lifting and lowering, and rotating and adjusting the boom according to the standard positioning parameters and the actual positioning parameters of the boom may specifically include:
- rotating the boom by initial angle φ' according to the initial angle φ', thus making a plane where the boom and the wellhead may be located perpendicular to a horizontal plane;
- comparing the actual length L' of the boom and the actual lifting length J' with the standard extension length L and the standard lifting length J, respectively to obtain ΔL=L−L', and ΔJ=J−J'.
- when ΔL may be a negative number, the actual length L' of the boom may be greater than the standard extension length L, and the boom may retract by ΔL. When ΔL may be a positive number, the actual length L' of the boom may be less than the standard extension length L, and the boom may extend by ΔL. The end of the boom may be adjusted back and forth.

when ΔJ may be a negative number, the actual lifting length J' may be greater than the standard lifting length J, and the lift cylinder may retract by ΔJ. When ΔJ may be a positive number, the actual lifting length J' may be less than the standard lifting length J, and the lift cylinder may extend by ΔJ. The end of the boom may be adjusted up and down.

After completing the automatic positioning of the wellhead by extending and retracting, lifting and lowering, and rotating and adjusting the boom according to the standard positioning parameters and the actual positioning parameters of the boom, the method may further include:

recording extending and retracting, lifting and lowering, and rotating parameters of the boom to form automatic control parameters; and controlling the boom to position according to the automatic control parameters when replacing tools.

A wellhead automatic positioning system of a plugging and perforating operation machine includes an initial module, an acquisition module, and a control module.

the initial module is configured to determine a wellhead position, and acquire standard positioning parameters of a boom according to the wellhead position and a tool string length, wherein the positioning parameters comprise a standard extension length L of the boom, a standard lifting length J, and a first included angle φ between a projection of the boom and a wellhead.

The acquisition module is configured to acquire actual positioning parameters of the boom, wherein the actual positioning parameters comprise an actual length L' of the boom, an actual lifting length J', and an initial angle φ' between the projection of the boom and the wellhead; and the control module is configured to extend and retract, lift and lower and rotate and adjust the boom according to the standard positioning parameters and the actual positioning parameters of the boom to complete the automatic positioning of the wellhead.

Compared with the prior art, the embodiments have the beneficial effects as follows.

According to the well automatic positioning method and the system of the plugging and perforating operation machine provided by the embodiments, when operating on the wellhead, a positional relationship between the boom and the wellhead can be obtained for further positioning calculation, and after the parameters for further control of the boom are acquired, the boom can be operated, making the boom positioned with the wellhead. No manual interference is needed in the process, the danger of the manual operation close to the wellhead is avoided, the number of workers is reduced, the operation efficiency is improved, the precision and the automation degree of wellhead operation are improved, and the practicability is high.

DETAILED DESCRIPTION OF THE EMBODIMENTS

The following describes the present disclosure in detail with reference to the drawings. Apparently, the described embodiments are merely a part rather than all of the embodiments of the present disclosure. All other embodiments obtained by a person of ordinary skill in the art based on the embodiments of the present disclosure without creative efforts shall lower within the scope of protection of the present disclosure.

Figure 1:
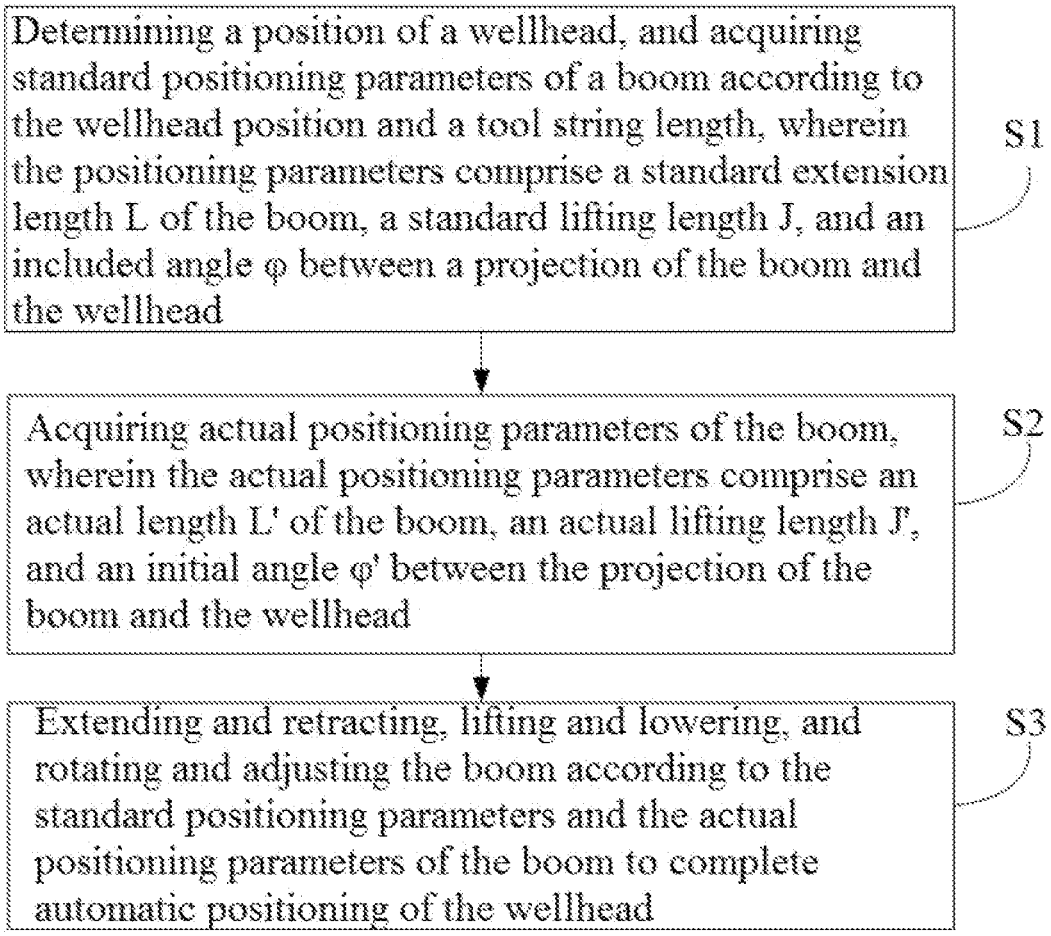
FIG. 1 is a block diagram of a well automatic positioning method of a plugging and perforating operation machine according to the present disclosure.
Figure 2:
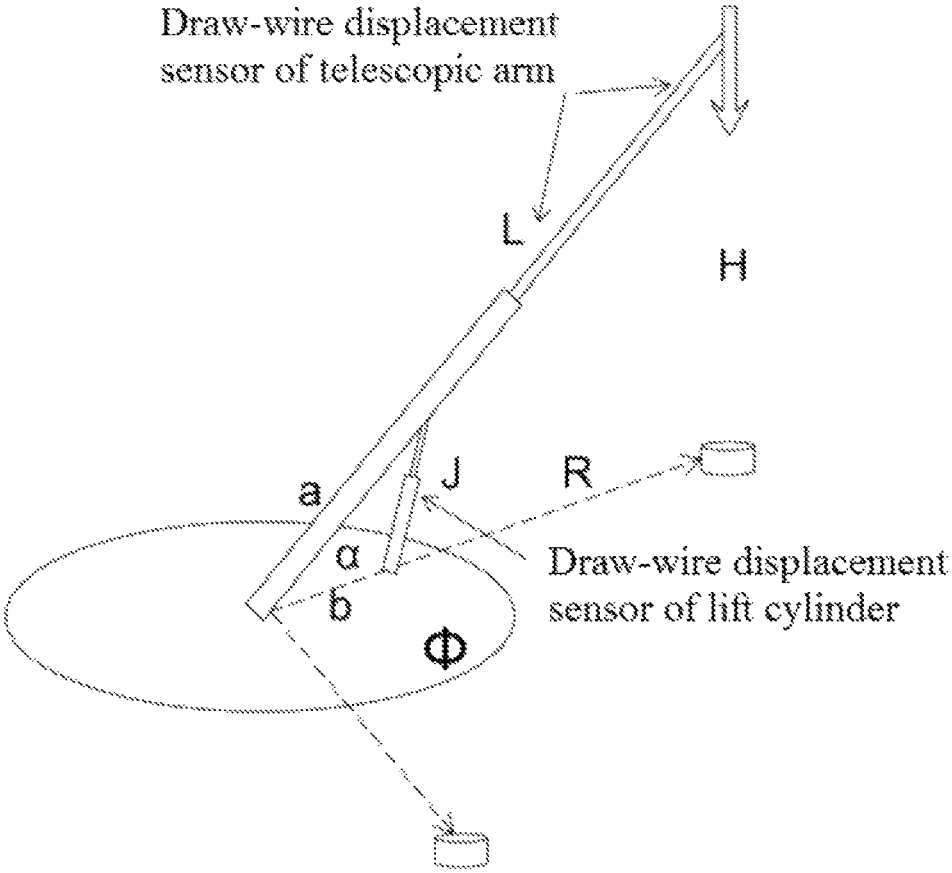
FIG. 2 is a schematic diagram of the well automatic positioning method of the plugging and perforating operation machine according to the present disclosure.
Figure 3:
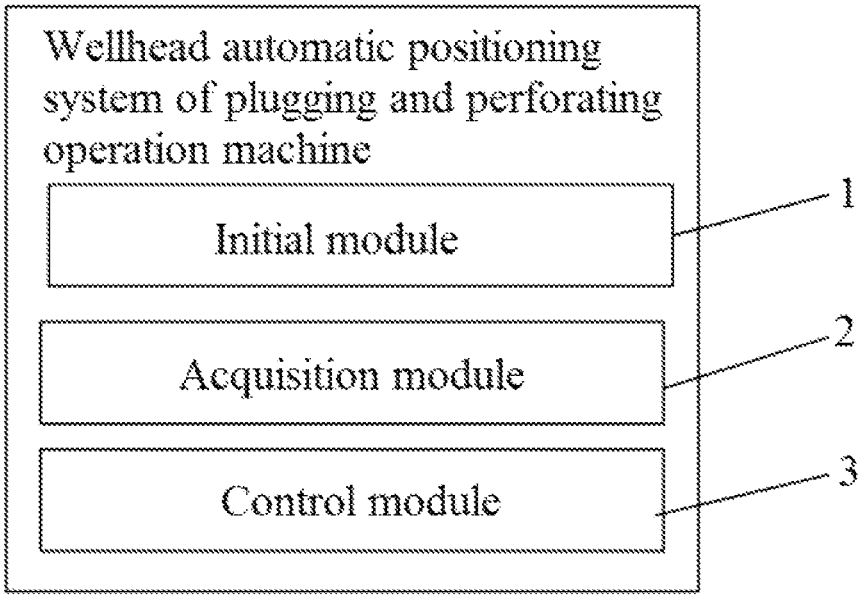
FIG. 3 is a structural schematic diagram of a well automatic positioning system of the plugging and perforating operation machine according to the present disclosure.

As shown in FIG. 1 to FIG. 3, a well automatic positioning method of a plugging and perforating operation machine includes the following steps.

In S1, a position of a wellhead is determined, and standard positioning parameters of a boom are acquired according to the wellhead position and a tool string length, where the positioning parameters include a standard extension length L of the boom, a standard lifting length J, and an included angle φ between a projection of the boom and the wellhead.

The position of the wellhead is acquired through a positioning component, and a distance R between the wellhead and the bottom of the boom, and the included angle between a projection of the boom and the wellhead are determined.

Exemplary, the positioning component includes an image identification device, or a positioning sensor. An image of the wellhead is acquired through a camera device, the wellhead is confirmed through image processing and identification, and the position of the wellhead is identified. A sensor at the wellhead may be further provided. When the boom rotates to the position of the wellhead, the position of the wellhead is confirmed after the sensor receiving a signal. The sensor may be an infrared sensor, and the position of the wellhead can be confirmed through signals at a transmitting end and a receiving end of the sensor. A rotating angle, i.e., the included angle φ, is acquired through a rotating disc encoder or angular displacement sensor installed on the boom, and the included angle φ is recorded.

The distance R between the wellhead and the bottom of the boom is a distance R between the wellhead and the bottom of the boom measured by a distance sensor.

Further, acquiring the standard positioning parameters of the boom according to the wellhead position and a tool string length specifically includes the following steps.

The distance R between the bottom of the boom and the wellhead is acquired according to the wellhead position.

A height H between an end of the boom and the wellhead is set according to the tool string length.

An included angle α between a lifted boom and a horizontal direction is obtained according to the distance R between the bottom of the boom and the wellhead and the height H between the end of the boom and the wellhead.

The standard extension length L of the boom is equal to $H \times \sin \alpha$.

The standard lifting length is as $J=\sqrt{a^2+b^2-2ab\cos\alpha}$, where a is a distance between the top of a lift cylinder and the bottom of the boom, b is a distance between the bottom of the lift cylinder and the bottom of the boom.

In S2, actual positioning parameters of the boom are acquired. The actual positioning parameters include an actual length L' of the boom, an actual lifting length J', and an initial angle φ' between the projection of the boom and the wellhead.

Acquiring actual positioning parameters of the boom specifically includes the following steps.

An extension length of the boom is collected through a first draw-wire displacement sensor installed on the boom, and the sum of the extension length and an original length of the boom is the actual length L' of the boom.

An extension length of the lift cylinder is collected through a second draw-wire displacement sensor installed on the lift cylinder, and the sum of the extension length of the lift cylinder of the boom and an original length of the lift cylinder is the actual lifting length J' of the lift cylinder.

An included angle between an initial position and a positioning position is acquired as the initial angle φ' through an angle sensor, or a recorded rotating angle is acquired as the initial angle φ' after rotating the boom to a positioned wellhead position.

In S3, according to the standard positioning parameters and the actual positioning parameters of the boom, the boom extends and retracts, lifts and lowers, rotates and is adjusted to complete automatic positioning of the wellhead.

Extending and retracting, lifting and lowering, and rotating and adjusting the boom according to the standard positioning parameters and the actual positioning parameters of the boom specifically include the following steps.

The boom rotates by initial angle φ' according to the initial angle φ', thus making a plane where the boom and the wellhead are located perpendicular to a horizontal plane.

The actual length L' of the boom and the actual length J' of the lift cylinder are compared with the standard extension length L and the standard lifting length J, respectively, so as to obtain $\Delta L=L-L'$, and $\Delta J=J-J'$.

When ΔL is a negative number, the actual length L' of the boom is greater than the standard extension length L, and the boom retracts by ΔL; and when ΔL is a positive number, the actual length L' of the boom is less than the standard extension length L, and the boom extends by ΔL; and the end of the boom is adjusted back and forth.

When ΔJ is a negative number, the actual length J' of the lift cylinder is greater than the standard length J, and the lift cylinder retracts by ΔJ; and when ΔJ is a positive number, the actual lifting length J' is less than the standard length J, and the lift cylinder extends by ΔJ; and the end of the boom is adjusted up and down.

Further, after completing the automatic positioning of the wellhead by extending and retracting, lifting and lowering, and rotating and adjusting the boom according to the standard positioning parameters and the actual positioning parameters of the boom, the method further includes the following steps.

Extending and retracting, lifting and lowering, and rotating parameters of the boom are recorded to form automatic control parameters.

When replacing the tool for the second time, the boom is controlled to position according to the automatic control parameters.

As the boom can return to an initial position at first when replacing a workpiece string, when performing the second positioning, the boom can be controlled to reach a standard position through the automatic control parameters.

Preferably, in the embodiment, extending and retracting, lifting and lowering, and rotating and adjusting the boom according to the standard positioning parameters and the actual positioning parameters of the boom further includes the following steps.

According to the difference between the standard positioning parameters and the actual positioning parameters of the boom, output values of each hydraulic cylinder are controlled.

The detailed embodiment further includes the following.

When the plugging and perforating operation machine arrives near the wellhead, the boom of the plugging and perforating operation machine enables an anti spray pipe string to align with the wellhead according to a predetermined position, so as to insert the anti spray pipe string string into a base of the plugging connector. The positioning operation process and data are recorded by a controller, thus finally achieving the wellhead automatic positioning function of the plugging and perforating operation machine.

A wellhead automatic positioning method of the plugging and perforating operation machine includes the following steps.

According to the relative position between the anti spray pipe string on the plugging and perforating operation machine and the wellhead, the wellhead positioning of the plugging and perforating operation machine can be regarded as the positioning of the boom thereof in the front and rear direction, the positioning of the boom thereof in the left and right direction, and the positioning of the boom thereof in the lifting and lowering direction. By operating a mechanical arm of the plugging and perforating operation machine through a handle, the anti spray pipe string string can be coaxial with the base of the plugging connector by adjusting in the front and rear direction, the left and right direction and the lifting and lowering direction. The wellhead positioning method of the plugging and perforating operation machine can easily, quickly, accurately and safely insert the anti spray pipe string into the base of the plugging connector. During the first operation, the plugging and perforating operation machine collects the data of the sensor, and after the program processing of the control system, the automatic wellhead positioning can be finally achieved.

The wellhead positioning principle of the plugging and perforating operation machine is as follows.

1. Positioning of the Plugging and Perforating Operation Machine in the Left and Right Direction The boom and a turntable of the plugging and perforating operation machine are connected into a whole adopting a hinge. The initial position of the turntable is zero, and an encoder is installed at a rotating shaft end of the turntable, and is configured to collect the number of left and right rotations of the boom of the plugging and perforating operation machine. A rotation angle is calculated by the controller to reflect a displacement angle of the mechanical arm of the plugging and perforating operation machine in the left and right direction, so as to achieve accurate positioning. Meanwhile, the controller records the sensor data of this operation, and the data is then applied to automatic wellhead positioning.

2. Positioning of the Plugging and Perforating Operation Machine in Front and Rear Direction and in Lifting and Lowering Direction A telescopic arm of the boom of the plugging and perforating operation machine comprises multiple sleeve arms, and a draw-wire displacement sensor is installed on each telescopic arm to collect the data of the extension length of the telescopic arm. The controller is configured to adjust the mechanical arm of the plugging and perforating operation machine in the front and rear direction to achieve accurate positioning. Meanwhile, the controller records the sensor data of this operation, and the data is then applied to automatic wellhead positioning.

The boom of the plugging and perforating operation machine is hinged to the lift cylinder, and the lift cylinder is also hinged to the turntable. The draw-wire displacement sensor is installed on the lift cylinder to collect the data of the telescopic length of the lift cylinder. The controller is configured to adjust the mechanical arm of the plugging and perforating operation machine in the lifting and lowering direction to achieve accurate positioning. Meanwhile, the controller records the sensor data of this operation, and the data is then applied to automatic wellhead positioning.

Then, the controller can achieve the simultaneous adjustment of the positioning of the mechanical arm in the front and rear direction and the positioning of the mechanical arm in the lifting and lowering direction by collecting, processing and analyzing the data of the sensor, and can also make the positioning adjustment of the mechanical arm in the lifting and lowering direction while remaining the position of the mechanical arm in the front and rear direction unchanged. In the same way, the position of the mechanical arm can be adjusted in the front and rear direction while remaining the position of the mechanical arm in the lifting and lowering direction unchanged. Meanwhile, the controller records the sensor data of this operation, and the data is then applied to automatic wellhead positioning.

A wellhead positioning device of a plugging and perforating operation machine includes:

an encoder, a draw-wire displacement sensor, an automatic control system and an operation device.

The embodiments have the advantages and effects that the wellhead positioning method of the plugging and perforating operation machine can achieve automation, and rapidly, accurately and safely insert a special joint of the plugging connector into the base of the plugging connector.

As shown in FIG. 3, a wellhead automatic positioning system of a plugging and perforating operation machine includes an initial module 1, an acquisition module 2, and a control module 3.

The initial module 1 is configured to determine a wellhead position, and acquire standard positioning parameters of a boom according to the wellhead position and a tool string length, where the positioning parameters include a standard extension length L of the boom, a standard lifting length J, and an included angle φ between a projection of the boom and a wellhead.

The acquisition module 2 is configured to acquire actual positioning parameters of the boom, where the actual positioning parameters include an actual length L' of the boom, an actual lifting length J', and an initial angle φ' between the projection of the boom and the wellhead.

The control module 3 is configured to extend and retract, lift and lower and rotate and adjust the boom according to the standard positioning parameters and the actual positioning parameters of the boom to complete the automatic positioning of the wellhead.

It is apparent for those skilled in the art that the above specific examples are only the preferred scheme of the present disclosure, so the improvements and changes that may be made by those skilled in the art to some parts of the present disclosure still embody the principles of the present disclosure and achieve the purposes of the present disclosure, and all belong to the scope of protection of the present disclosure.

What is claimed is:

1. A wellhead automatic positioning method of a plugging and perforating operation machine, comprising:

arranging the plugging and perforating operation machine adjacent to a wellhead;

acquiring an image of a wellhead through a camera device, confirming the wellhead through image processing and identification, and identifying a position of the wellhead, so as to determine the position of the wellhead, or providing a positioning sensor at the wellhead, after the positioning sensor receiving a signal, confirming a position of the wellhead when a boom of the plugging and perforating operation machine rotates to the position of the wellhead, and acquiring standard positioning parameters of the boom according to the wellhead position and a tool string length, wherein the positioning parameters comprise a standard extension length L of the boom, a standard lifting length J, and a first included angle φ between a projection of the boom and the wellhead;

acquiring actual positioning parameters of the boom through a first draw-wire displacement sensor, a second draw-wire displacement sensor and an angle sensor, wherein the actual positioning parameters comprise an actual length L' of the boom, an actual lifting length J', and an initial angle φ' between the projection of the boom and the wellhead; and extending and retracting, lifting and lowering the boom by operating a mechanical arm of the plugging and perforating operation machine through a handle, and rotating and adjusting the boom through a turntable that is hinged to the boom according to the standard positioning parameters and the actual positioning parameters of the boom, enabling an anti spray pipe string to align with the wellhead by the boom of the plugging and perforating operation machine according to a predetermined position, so as to insert the anti spray pipe string into a base of a plugging connector to complete automatic positioning of the wellhead.

2. The wellhead automatic positioning method of the plugging and perforating operation machine according to claim 1, wherein determining the position of the wellhead comprises:

acquiring the position of the wellhead through a positioning component, and determining a first distance R between the wellhead and a bottom of the boom, and the first included angle between the projection of the boom and the wellhead.

3. The wellhead automatic positioning method of the plugging and perforating operation machine according to claim 2, wherein the positioning component comprises an image identification device, or a positioning sensor.

4. The wellhead automatic positioning method of the plugging and perforating operation machine according to claim 2, wherein determining the first distance R between the wellhead and the bottom of the boom is measuring a distance R between the wellhead and the bottom of the boom by a distance sensor.

5. The wellhead automatic positioning method of the plugging and perforating operation machine according to claim 2, wherein acquiring the standard positioning parameters of the boom according to the wellhead position and a tool string length specifically comprises:

acquiring the first distance R between the bottom of the boom and the wellhead according to the wellhead position;

setting a height H between an end of the boom and the wellhead according to the tool string length;

obtaining a second included angle α between the boom and a horizontal direction according to the first distance R between the bottom of the boom and the wellhead and the height H between the end of the boom and the wellhead:

the standard extension length L of the boom is equal to $H \times \sin \alpha$;

the standard lifting length is as $J=\sqrt{a^2+b^2-2abCosa}$, wherein a is a second distance between a top of a lift cylinder and the bottom of the boom, and b is a third distance between a bottom of the lift cylinder and the bottom of the boom.

6. The wellhead automatic positioning method of the plugging and perforating operation machine according to claim 5, wherein acquiring the actual positioning parameters of the boom specifically comprises:

collecting an extension length of the boom through the first draw-wire displacement sensor installed on the boom, wherein a sum of the extension length and an original length of the boom is the actual length L' of the boom;

collecting an extension length of the lift cylinder through the second draw-wire displacement sensor installed on the lift cylinder, wherein a sum of the extension length of the lift cylinder of the boom and an original length of the lift cylinder is the actual lifting length J' of the lift cylinder; and acquiring a third included angle between the boom at an initial position and the boom at a positioning position as the initial angle φ' through the angle sensor.

7. The wellhead automatic positioning method of the plugging and perforating operation machine according to claim 6, wherein extending and retracting, lifting and lowering, and rotating and adjusting the boom according to the standard positioning parameters and the actual positioning parameters of the boom specifically comprise:

rotating the boom by initial angle φ' according to the initial angle φ', thus making a plane where the boom and the wellhead are located perpendicular to a horizontal plane;

comparing actual length L' of the boom and actual lifting length J' with the standard extension length L and the standard lifting length J, respectively to obtain $\Delta L=L-L'$, and $\Delta J=J-J'$:

wherein when ΔL is a negative number, the actual length L' of the boom is greater than the standard extension length L, and the boom retracts by ΔL; when ΔL is a positive number, the actual length L' of the boom is less than the standard extension length L, and the boom extends by ΔL; and the end of the boom is adjusted back and forth; and when ΔJ is a negative number, the actual lifting length J' is greater than the standard lifting length J, and the lift cylinder retracts by ΔJ; when ΔJ is a positive number, the actual lifting length J' is less than the standard lifting length J, and the lift cylinder extends by ΔJ; and the end of the boom is adjusted up and down.

8. The wellhead automatic positioning method of the plugging and perforating operation machine according to claim 1, wherein after completing the automatic positioning of the wellhead by extending and retracting, lifting and lowering, and rotating and adjusting the boom according to the standard positioning parameters and the actual positioning parameters of the boom, the method further comprises:

recording extending and retracting, lifting and lowering, and rotating parameters of the boom to form automatic control parameters; and controlling the boom to position according to the automatic control parameters when replacing tools.

9. A wellhead automatic positioning system of a plugging and perforating operation machine, comprising a camera device, a positioning sensor, an initial module, an acquisition module, and a control module;

wherein the plugging and perforating operation machine is arranged adjacent to a wellhead;

the camera device is configured to acquire an image of a wellhead through a camera device, the image is configured to be processed and identified to confirm the wellhead, so as to determine the position of the wellhead;

the positioning sensor is provided at the wellhead and is configured to receive a signal, after the positioning sensor receiving the signal, a position of the wellhead is confirmed when a boom of the plugging and perforating operation machine rotates to the position of the wellhead;

the initial module is configured to determine a wellhead position, and acquire standard positioning parameters of a boom according to the wellhead position and a tool string length, wherein the positioning parameters comprise a standard extension length L of the boom, a standard lifting length J, and a first included angle φ between a projection of the boom and a wellhead;

the acquisition module is configured to acquire actual positioning parameters of the boom through a first draw-wire displacement sensor, a second draw-wire displacement sensor and an angle sensor, wherein the actual positioning parameters comprise an actual length L' of the boom, an actual lifting length J', and an initial angle φ' between the projection of the boom and the wellhead; and the control module is configured to control the boom to extend and retract, lift and lower by operating a mechanical arm of the plugging and perforating operation machine through a handle, control the boom to rotate and adjust through a turntable that is hinged to the boom according to the standard positioning parameters and the actual positioning parameters of the boom and control an anti spray pipe string to align with the wellhead by the boom of the plugging and perforating operation machine according to a predetermined position, so as to insert the anti spray pipe string into a base of a plugging connector to complete the automatic positioning of the wellhead.

* * * * *